US005256123A

United States Patent [19]

Reinbolt

[11] Patent Number: 5,256,123

[45] Date of Patent: Oct. 26, 1993

[54] FEMALE ABDOMINAL EXERCISE DEVICE

[76] Inventor: Marsha L. Reinbolt, 4335 Beck, Maumee, Ohio 43537

[21] Appl. No.: 746,711

[22] Filed: Aug. 19, 1991

[51] Int. Cl.[5] ..... A63B 21/008

[52] U.S. Cl. ..... 482/113; 482/111

[58] Field of Search ..... 128/778; 482/111, 112, 482/113, 909; 600/38, 39

[56] References Cited

U.S. PATENT DOCUMENTS

| | | | |
|---|---|---|---|
| 3,726,273 | 4/1973 | Cole | 482/112 |
| 3,752,150 | 8/1973 | Harris | 600/38 |
| 4,048,985 | 9/1977 | Sasse | 128/778 |
| 4,050,449 | 9/1977 | Castellana et al. | 482/113 |
| 4,167,938 | 9/1979 | Remih | 482/909 |
| 4,653,514 | 3/1987 | Shapiro | 482/121 |
| 4,768,522 | 9/1988 | Shapiro | 482/92 |

*Primary Examiner*—Richard J. Apley
*Assistant Examiner*—Lynne Reichard
*Attorney, Agent, or Firm*—George R. Royer

[57] ABSTRACT

The subject device is an apparatus structured to help facilitate the process of exercising the internal vaginal muscles, and comprises, in general, a hollow longitudinally extending member capable of being alternately contracted about its lower girth and its upper posterior portion to rhythmatically produce an internal wave action inside the device to both exercise and strengthen the vaginal muscles. The device is used by initially filling the vaginal insert with a fluid to a given volume and pressure determined by the user, through a detachable fill-empty device affixed to the device.

The device is provided with an optional differential pressure flow gauge, or any other differential pressure indicator to measure rhythmatic action and strength of the resulting wave actions.

In its overall form, the subject device is an apparatus comprising a hollow longitudinally extending exercise member capable of being contracted about its girth by the interior vaginal muscles for purposes of exercising such interior muscles for strengthening purposes. Integrally formed inside the subject apparatus are two separate hollow chambers of equal size and generally aligned coaxially with one another. The contractable exercise member can be expanded through internal fluid pressure means with fluid moving back and forth between the respective two chambers, such fluid movement causing a wave action that can be generated by internal pressure or external pressure.

3 Claims, 3 Drawing Sheets

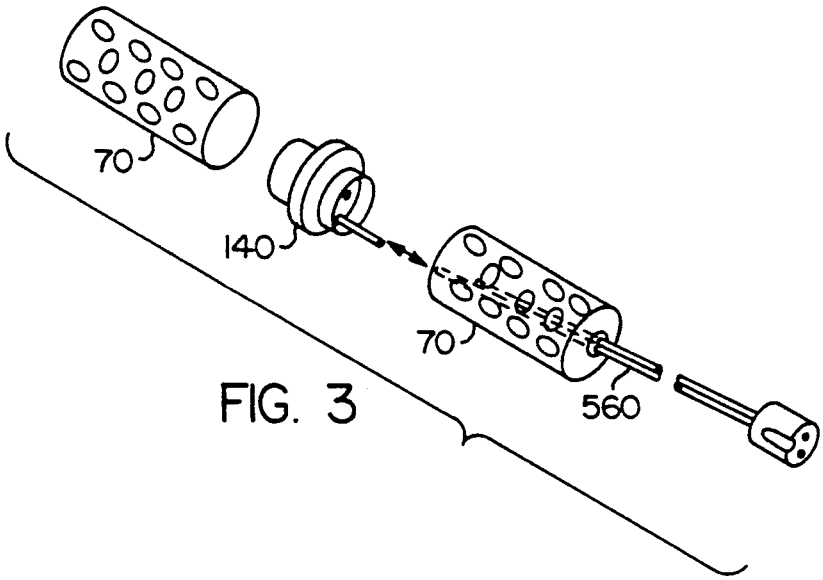
FIG. 3
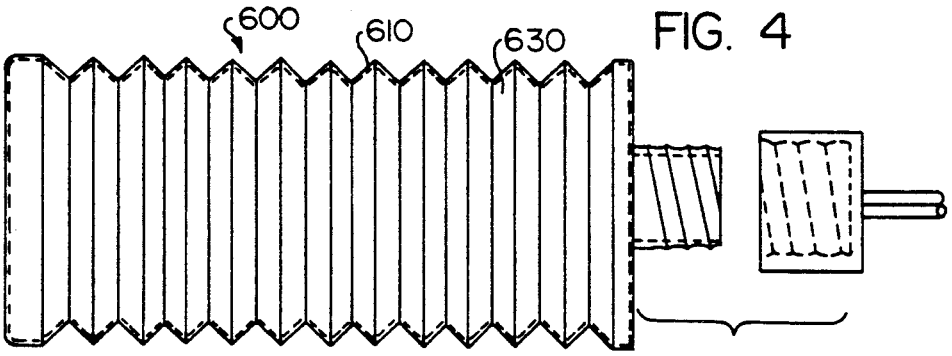
FIG. 4
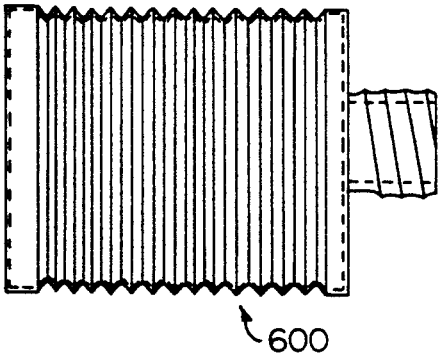
FIG. 5
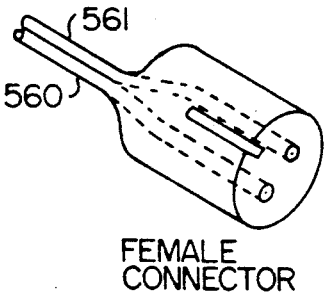
FIG. 7
FIG. 6
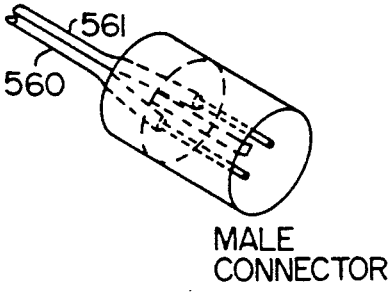

FEMALE ABDOMINAL EXERCISE DEVICE

DISCUSSION OF PRIOR ART AND BACKGROUND OF INVENTION

The subject invention is a device structured and deployed as a vaginal exercise device. Such device is structured as a longitudinally extending hollow member that is adapted to be inserted into the vagina to be manipulated by either internally or externally directed pressures to exercise the vagina walls. More particularly, in this regard the internal vaginal muscles located within the abdomen and surrounding the vaginal cavity are considered a contractive type of muscles. This type of movement of these muscles can be by a voluntary effort. Further, this contractive muscle is the same muscle that controls the urinary tract. The vaginal muscle is usually stretched by pregnancy and natural childbirth to the point where it loses its elasticity and ability to contract. The resultant effect in many cases is to cause loss of urinary control and other matters. Thus, as can be seen, the relative strength muscle is important for the health and well-being of a female.

In relation to the subject invention, there are devices in the prior art that are structured to function as vaginal exercising devices and such devices are somewhat similar to the subject device and are longitudinally extending devices adapted to be inserted into the vagina for the exercising process. Examples of such prior art devices are seen in U.S. Pat. Nos. 4,167,938, 2,507,858, 4,768,522, 4,050,499, 3,726,273.

A review of the prior art reveals that there is no known device in the prior art that utilizes a longitudinally extending hollow tubular member which has the capability of generating differential wave-like action imparted to a fluid inside the member, or alternately, receiving differential wave action from external pressure imposed peripherally against the outer surface of the member. Additionally, no known inventions function to measure the strength of contractability of the vagina walls. The subject invention incorporates the idea and the subject apparatus is directed accordingly.

The subject invention is thus conceived as an apparatus to incorporate such features and differentiate over the prior art structures and the following objects of the subject invention are directed accordingly.

Thus, the subject invention is an exercising device utilized for the purpose of exercising the internal abdominal muscles of a female, particularly those muscles that are located inside and around the vaginal walls. The invention is adapted to facilitate the process of exercising such muscles by the process of alternately and rhythmactically contracting and expanding the front and rear part of the vaginal cavity, thus creating a wave-like effect inside the vaginal insert of this invention.

OBJECTS

It is an object of the subject invention to provide an apparatus for aiding in the exercise of the abdominal muscles in a female;

It is another object of the subject invention to provide an apparatus to help strengthen the female abdominal muscles prior to pregnancy to ease natural childbirth;

It is another object of the subject invention to provide an apparatus to help strengthen the abdominal muscles;

Still another object of the subject invention is to provide an improved vaginal exercise device;

Yet another object of the subject invention is to provide a vaginal exercise device based on the use of the differential fluid pressure fluid flow.

Other and further objects of the subject invention will become apparent from a reading of the description taken in conjunction with the claims and drawings.

DRAWINGS

FIG. 3 is a perspective view of the subject device showing it in an exploded fashion;

FIG. 4 is a side elevational view of the expandible air expulsion member used in the subject device;

FIG. 5 is a side elevational view of the air explusion member used in conjunction with the subject apparatus as shown in the contracted position;

FIG. 6 is a perspective view of the quick MALE connector;

FIG. 7 is a perspective view of the quick FEMALE connector;

DESCRIPTION OF GENERAL EMBODIMENT

Figure 1:
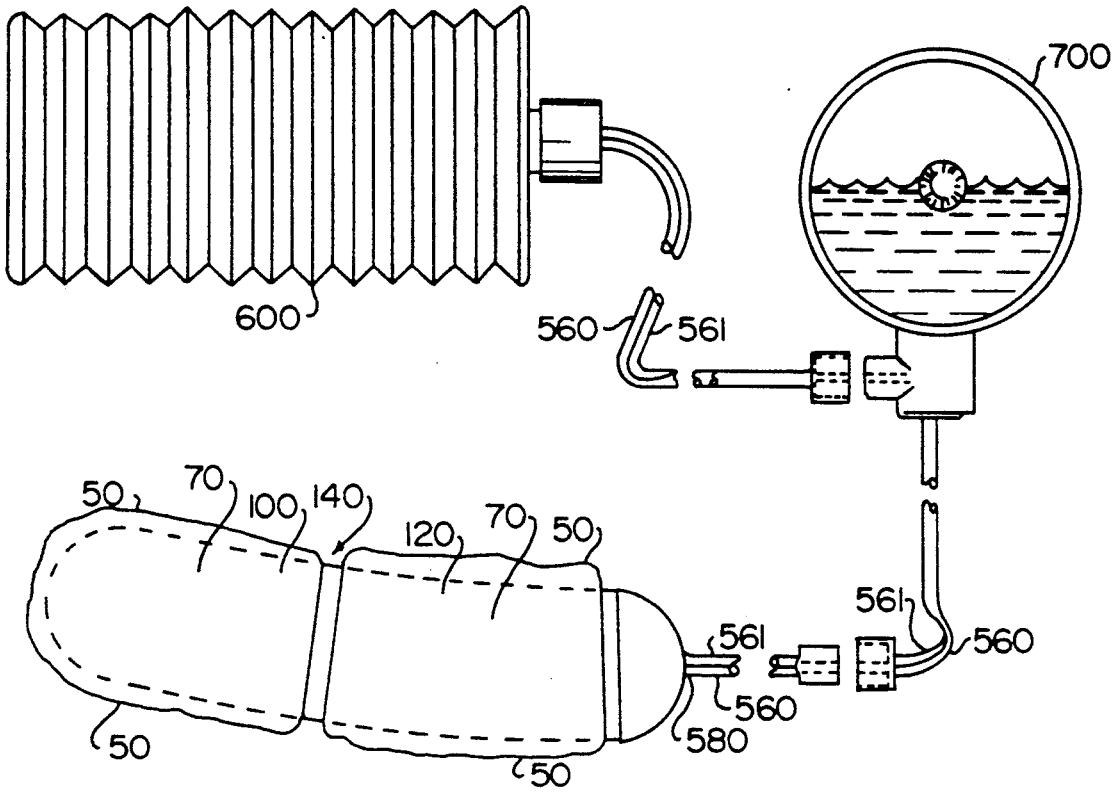
FIG. 1 is an overall view of the apparatus incorporating the subject invention.

The subject device is an apparatus structured to help facilitate the process of exercising the internal vaginal muscles, and comprises, in general, a hollow longitudinally extending member capable of being alternately contracted about its lower girth and its upper posterior portion to rhythmatically produce an internal wave action inside the device to both exercise and strengthen the vaginal muscles. The device is used by initially filling the vaginal insert with a fluid to a given volume and pressure determined by the user, through a detachable fill-empty device affixed to the device.

The device is provided with an optional differential pressure flow gauge, or any other differential pressure indicator to measure rhythmatic action and strength of the resulting wave actions.

In its overall form, the subject device is an apparatus comprising a hollow longitudinally extending exercise member capable of being contracted about its girth by the interior vaginal muscles for purposes of exercising such interior muscles for strengthening purposes. Integrally formed inside the subject apparatus are two separate hollow chambers of equal size and generally aligned coaxially with one another. The contractable exercise member can be expanded through internal fluid pressure means with fluid moving back and forth between the repsective two chambers, such fluid movement causing a wave action that can be generated by internal pressure or external pressure.

In its overall form, the subject device is an apparatus comprising a hollow longitudinally extending exercise member capable of being contracted about its girth by the interior vaginal muscles for purposes of exercising such interior muscles for strengthening purposes. Integrally formed inside the subject apparatus are two separate hollow chambers of equal size and generally aligned coaxially with one another. The contractable exercise member can be expanded through internal fluid pressure means with fluid moving back and forth between the respective two chambers, such fluid movement causing a wave action that can be generated by internal pressure or external pressure.

Thus, as can be seen, the subject apparatus is devised to help the process of exercising the internal vaginal muscles, and comprises, in general, a hollow longitudinally extending member capable of being alternately contracted about its lower girth and its upper posterior to rhythmatically produce a wave action inside the hollow chambers of the apparatus to exercise and strengthen the vaginal muscles and the general concept is based on the generation of a wave-like motion, alternately referred to as a pulsatory motion, of fluid inside a device with multiple coaxially aligned chambers through which the fluid reciprocally moves back and forth in such reciprocal pulsating motions.

DESCRIPTION OF PREFERRED EMBODIMENT

In describing the subject invention, it is to be noted that the following description is of only one embodiment of the invention herein and the following description shall not be construed as limiting the scope of the invention as set forth in the claims herein.

Figure 2:
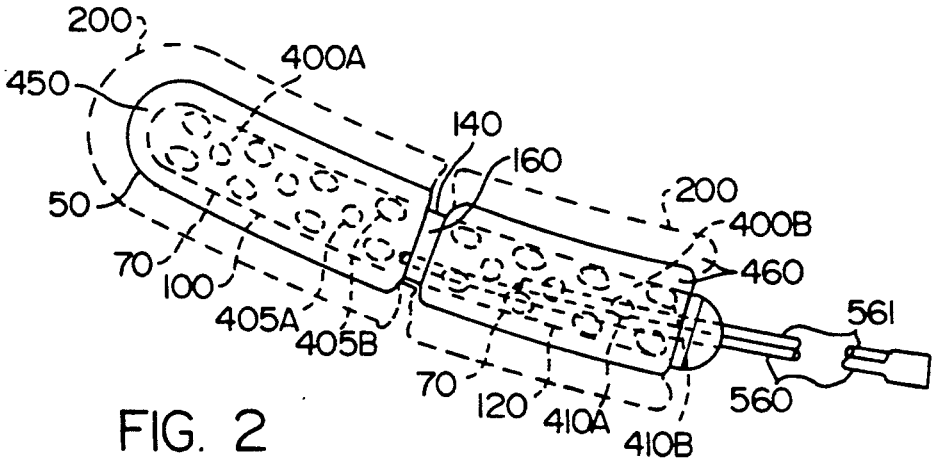
FIG. 2 is a side elevational view of the subject device, showing same in phantom cross-sectional configuration.

Referring now to the drawings in which is shown a preferred embodiment of the subject invention, and particularly to FIGS. 1, 2 and 3.

As shown in FIG. 1, the basic and most general element of the subject device is an elongated, or longitudinally extending male member 50, which male member comprises the basic structure of the subject apparatus. Such male member 50 is comprised of a flexible material, so as to be both extendable and expandable in lateral directions. As can be seen, the male member 50 is a hollow member having an internal hollow chamber 70. The chamber 70 is essentially comprised of two portions, namely, a first portion 100 and a second portion 120. Essentially, the first portion 100 is concentrically integrated to the second portion in a longitudinal manner such that the male member 50 comprises two distinct internal chamber portions 100 and 120 aligned with one another. Thus, as can be seen from FIGS. 1, 2 and 3, the internal chamber 70 is formed into two distinct, preferably of equal size, internal chamber portions, preferably of equal size, that are separable by an intermediate wall 140. As can be seen from the drawings, the intermediate wall 140 is preferably a circular member of fairly rigid construction, such circular construction being comparable in size and shape to the internal diametric cross-sectional configuration of each of the two opposing internal chamber portions 100 and 120.

As can be seen from the drawings, the intermediate wall 140 has two orifices 160 and 180 therein, each adapted to communicate the internal chamber portions 100 and 120 with one another. The size of such orifices 160 and 180 may vary, depending on the particular application involved.

As can be observed from the drawings, first internal chamber portion 100 is preferably of cylindrical disposition, while the second internal chamber portion is also preferably of a cylindrical configuration, and preferably of equal size to the first chamber portion. More specifically, in the preferred embodiment of the subject device, the first chamber portion 100 is equal and similar in size and shape to the second chamber portion 120. These latter features are not critical to the implementation of the subject invention, however, and the relative sizes and shapes of the two internal chamber portions may vary.

As stated above, the intermediate wall 140 separates the first internal chamber portion 100 from the second internal chamber portion 120 so that the two latter chamber portions are separate hollow chambers, except for the small circular aperture 160 that is formed in the intermediate wall 100. Thus, the circular aperture 140 permits fluid internally contained in the two internal chamber portions to be moved back and forth between such internal chamber portions.

In the preferred embodiment of the subject invention, the external circumferential wall 200 of the male member 50 is comprised of a flexible material so that both the first end 200 and the second end can be flexed laterally, and longitudinally, as well as being expandable in a radial manner so that the internal generated pressure from inside the respective internal chamber portions 100 and 120 will cause the outer surface of the device to expand radially as well as longitudinally as the pressure in either one of the other of such chambers is filled with fluid.

As can be seen from the drawings, in the embodiment shown in FIG. 3, the first internal chamber portion 100 and the second internal chamber portion 120 are formed of two separate but identical pliable and flexible internal containment members 400A and 400B with each having a plurality of openings 405A, 405B . . . and 410A, 410B respectively, on the surface of each with such openings being adapted to communicate from the inside of the internal chamber to the areas outside thereof. Disposed between the respective internal containment members 400A and 400B are cylindrical spatial zones 450 and 460 that surround the internal containment members in a circumferential manner and are enclosed within the internal male member.

As can be seen in FIG. 3, when fluid is injected into the internal chambers 100 and 120, it will pass through the openings 405A, 405B . . . and 410A, 410B respectively, to the cylindrical spatial zones 450 and 460 to help distend the external male member in both a longitudinal and radial member.

As can be further seen from the drawings, the vertical cylinder wall 140 that separates the first internal portion 100 from the second internal portion 120 is formed with an opening 500 therein, such opening being adapted to pass fluid from one internal chamber to another internal chamber and reciprocally back to the other chamber. This opening 500 should be sufficiently large to permit a free flow of fluid from one chamber to another without impedance. A second opening 540 is formed in the wall 140 and this second opening is adapted to hold a tubular member 560 of relatively minimal diameter. This tube is, as shown in FIG. 4, inserted inside the second internal chamber portion to thus communicate inside the internal chamber 100. As can be observed from FIG. 4, tubular member 560 does not communicate inside second internal chamber 120, but passes on its far end to the second end of the male member 70 out of opening 580 in such second end to the fluid filler member 600. As can be seen from the drawings, fluid filler member 600 is a collapsible member that has foldable external balls 610 that permit the fluid filler member to be expanded or contracted as desired with appropriate manual forces. As can be seen from the drawings, the fluid filler member will expel fluid from its internal chamber 630 to inject such fluid through tubular member 560 to fill the internal chamber members 100s and 120.

Figure 8:
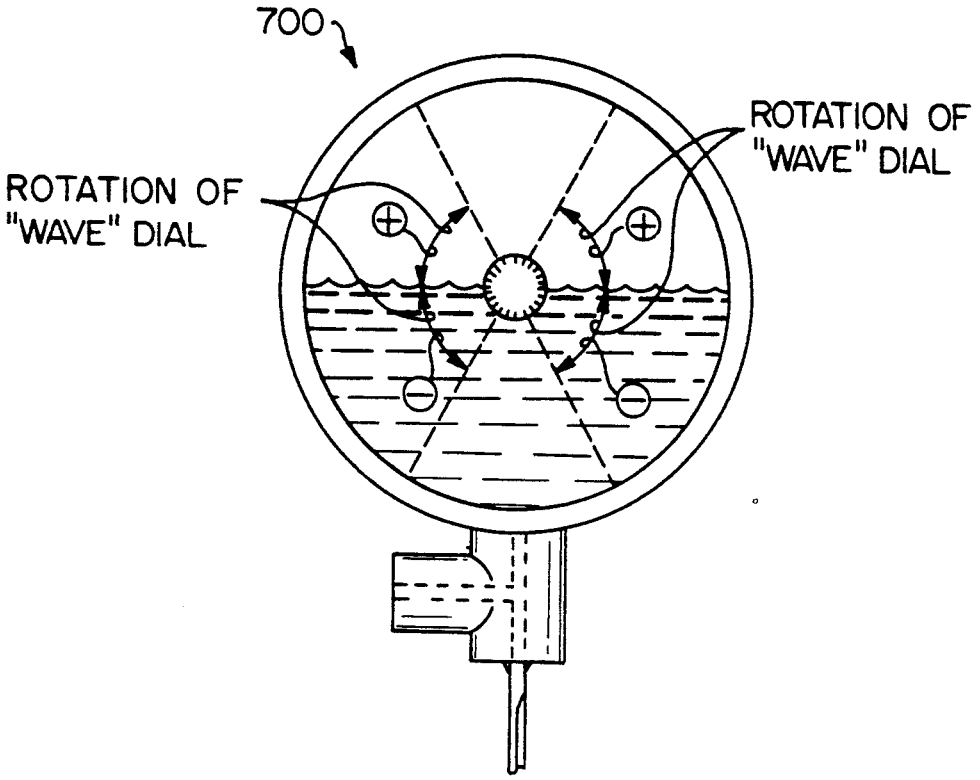
FIG. 8 is a frontal view of the differential pressure gauge optionally used in conjunction with the subject apparatus.

As seen from the drawings, and particularly FIG. 8, a pressure differential gauge 700 is used to measure differential external and internal pressure, as also seen in FIG. 1, on the male member 70. A dial is provided to measure and indicate the wave pressure and fluctuation accordingly. This gauge is inserted along tubular member 560 at some appropriate juncture.

I claim:

1. A device for exercising vaginal muscles within a vaginal cavity, such apparatus comprising:

(a) an extending male member having a longitudinally extending central axis and a longitudinally extending hollow member said hollow member extending in the longitudinal direction of the longitudinally extending axis of the longitudinally extending male member, said hollow member having two chambers therein, each chamber being aligned along a common central axis, and wherein said hollow member has a plurality of openings therein which openings extend from the inside of the member to portion outside said member.

2. A device for exercising vaginal walls within a vaginal cavity comprising:

(a) a male member adapted to be inserted in the vaginal cavity, comprised of a flexible and pliable outer shell, and wherein said male member has a hollow member extending along the longest portion of said male member, said hollow member being divided into two separate longitudinally and coaxially aligned chambers divided by an internal wall, said internal wall having two openings therein communicating said aligned chambers with one another, and wherein said aligned chambers are of equal size and shape; and wherein said hollow member has a plurality of openings therein, with such openings extending from the aligned chambers inside said hollow member to spatial areas outside said hollow member.

3. A device for exercising vaginal walls within a vaginal cavity, and adapted to be inserted longitudinally inside a vaginal cavity, said device comprising:

(a) a male member having a longitudinal central axis, said male member being adapted to be inserted longitudinally inside a vaginal cavity, said male member being comprised of a flexible external surface, and wherein said male member has two separate internal chambers, specifically a first internal chamber and a second internal chamber, with the first internal chamber and said second internal chamber being of equal size and shape and with said first internal chamber and said second internal chamber being coaxially aligned with one another along the longitudinal central axis of the male member, with said first internal chamber and said second internal chamber each having an internal spatial area therein;

(b) internal wall means separating said first internal chamber and said second internal chamber, said wall means having two separate apertures therein that communicate the internal spatial area of the first internal chamber with the internal spatial area of the second internal chamber;

(c) first containment means with an outer surface and second containment means, with an outer surface, each comprised of pliable material, with said first containment means having an inside space therein and said second containment means having an inside space, and wherein said first containment means has a plurality of openings in its surface and said second containment means has a plurality of openings in its outer surface, said first containment means being disposed inside said first internal chamber, with a surrounding spatial area existing outside the outer surface of said first containment means within the first internal chamber, and said second containment means being disposed inside said second internal chamber, with a surrounding spatial area outside the outer surface of said second containment means within the second internal

* * * * *